United States Patent [19]

Schmidt et al.

[11] Patent Number: 4,481,030

[45] Date of Patent: Nov. 6, 1984

[54] TANTALUM-COPPER ALLOY AND METHOD FOR MAKING

[75] Inventors: Frederick A. Schmidt; John D. Verhoeven; Edwin D. Gibson, all of Ames, Iowa

[73] Assignee: The United States of America as represented by the United States Department of Energy, Washington, D.C.

[21] Appl. No.: 500,102

[22] Filed: Jun. 1, 1983

[51] Int. Cl.[3] ..... C22B 4/00

[52] U.S. Cl. ..... 75/10 C; 75/10 R; 75/12; 75/84

[58] Field of Search ..... 75/10–12, 75/84

[56] References Cited

U.S. PATENT DOCUMENTS

| | | | |
|---|---|---|---|
| 3,493,364 | 2/1970 | Nakanishi | 75/12 |
| 3,802,923 | 4/1974 | Spanur | 136/178 |
| 3,905,803 | 9/1975 | Bianchi | 75/10 C |
| 4,027,720 | 6/1977 | Plockinger | 75/10 C |
| 4,146,681 | 3/1979 | Spanur | 429/54 |

*Primary Examiner*—Peter D. Rosenberg

*Attorney, Agent, or Firm*—James W. Weinberger; Walter L. Rees; Michael F. Esposito

[57] ABSTRACT

A tantalum-copper alloy can be made by preparing a consumable electrode consisting of an elongated copper billet containing at least two spaced apart tantalum rods extending longitudinally the length of the billet. The electrode is placed in a dc arc furnace and melted under conditions which co-melt the copper and tantalum to form the alloy.

8 Claims, 2 Drawing Figures

TANTALUM-COPPER ALLOY AND METHOD FOR MAKING

CONTRACTUAL ORIGIN OF THE INVENTION

The United States Government has rights in this invention pursuant to Contract No. W-7405-ENG-82 between the U.S. Department of Energy and Iowa State University.

BACKGROUND OF THE INVENTION

This invention relates to tantalum-copper alloys and a method for making these alloys.

Heretofore, to the best of our knowledge, alloys of tantalum and copper have not been known. This is due to the difficulty of melting tantalum and copper together when the melting temperature of tantalum is significantly higher than the temperature at which copper boils. Furthermore, the solubility of tantalum in copper has been reported to be only about 0.009 atom percent at 1200° C.

It has been speculated that, a wire formed of tantalum-copper alloy would have substantially greater tensile strength than plain copper wire, while retaining the current-carrying capacity of the copper. However, there have been no tantalum-copper alloys available to test this theory, because there has been no known method for preparing such an alloy.

SUMMARY OF THE INVENTION

A method has been developed by which tantalum-copper alloys may be prepared. The method of the invention for making tantalum-copper alloys consists of first preparing a consumable electrode. The electrode is an elongated copper billet containing at least two spaced apart tantalum rods extending longitudinally the length of the billet. The weight percent of tantalum in the electrode is equal to the weight percent of tantalum in the alloy. The electrode is then melted by striking and maintaining a dc arc between one end of the electrode and a container to receive the molten electrode as it melts to form the alloy. The distance between the end of the electrode and the molten alloy is carefully controlled in order to melt the tantalum at about the same rate as the copper is melted so that as the electrode is melted, a homogeneous mixture of tantalum and copper is formed in the receiver. The molten homogeneous mixture of copper and tantalum is then cooled to form the tantalum-copper alloy.

The tantalum is present in the copper matrix as discrete, randomly distributed and oriented dendritic-shaped particles. It is expected that alloys containing up to about 50 weight percent tantalum can be prepared by the process of the invention.

It is therefore one object of the invention to provide a tantalum-copper alloy.

It is the other object of the invention to provide a method for preparing a tantalum-copper alloy.

DESCRIPTION OF THE PREFERRED EMBODIMENT

Figure 1:
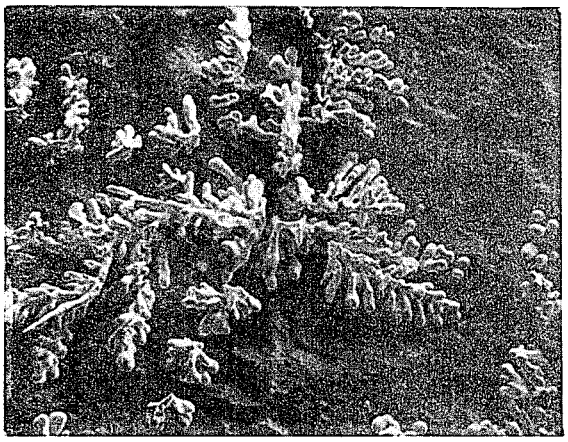
FIG. 1 is a scanning electron micrograph of a 19.5 weight percent tantalum-copper alloy taken at 475 multiplication.

These and other objects of the invention may be met by first preparing a consumable electrode. An elongated copper billet is provided with a plurality of evenly spaced, longitudinal slots extending the length of the billet. Into each slot is placed a length of tantalum which is uniform in cross-section and which extends the length of the slot. The tantalum in the slot is then enclosed with copper to hold the tantalum in the electrode firmly in place completing the electrode. The total weight percent of tantalum in the electrode is equal to the weight percent of the tantalum in the alloy. The electrode is then placed into a dc arc furnace and one end is inserted into the receiver of a water-cooled copper mold which has been lined with graphite to retard the rate of cooling of the molten metal. The furnace is evacuated and back-filled with about two-thirds atmosphere of argon gas. An arc is struck and maintained between the one end of the electrode and the mold to initiate melting of the electrode into the mold. As the end of the electrode melts, the distance between the end and the molten alloy is controlled carefully in order to melt the tantalum at about the same rate as the copper is melted so that as melting takes place, a molten homogeneous mixture of tantalum and copper is formed in the mold, which when cooled forms the alloy.

The consumable electrode can be configured in several different ways. For example, in addition to strips of tantalum placed in slots evenly spaced about the periphery of the copper billet, several thin tantalum rods could be placed in parallel longitudinal holes drilled in the copper billet. It is important the tantalum be divided into at least two, preferably four or more strips or rods of uniform cross-section which are evenly spaced laterally throughout the copper bar or rod. The tantalum must be evenly distributed longitudinally throughout the copper so that as the copper and tantalum melt individually, a homogeneous melt is formed. Preferably, the tantalum is firmly afixed to the copper billet so that as the electrode melts, a piece of unmelted tantalum could not separate from the electrode and fall into the melt.

The electrode is melted into a water-cooled copper mold which is lined with graphite to retard the cooling rate. This is preferred so that the molten copper and tantalum can form a homogeneous molten mixture before solidification takes place.

The furnace is a dc consumable arc furnace. The electrode is hung in the furnace with straight polarity, i.e. the electrode is negative. The particular furnace was operated at between 1700 and 1800 amps dc with the voltage maintained at 25 to 35 volts. The current and voltage will depend upon the particular furnace and size of electrode being melted and its determination is within the skill of the artisan. Preferable the ambient atmosphere is pumped from the furnace which is then back filled with a atmosphere of inert gas such as argon.

The particular electrode configuration in which longitudinal strips of tantalum are embedded in a copper billet permits co-melting of the tantalum and copper. As the arc is struck, the copper melts back rapidly several inches exposing the tantalum strips. The arc then transfers to the tip of the longest tantalum strip which now projects below the copper, melting it, before jumping to the next longest tantalum strip. The copper melts slowly back from the heat generated in the tantalum strips.

This continues until the electrode has completely melted. The distance between the tip of the tantalum strips and the molten metal must be continuously adjusted to retain the arc at the tip of the longest strip in order to melt the tantalum at the same rate as the copper is melted and form a homogeneous tantalum-copper melt.

While the amount of tantalum that can be alloyed with copper is unknown, because no phase diagrams are available for this system, it is believed that an alloy of up to about 50 weight percent tantalum is possible with the process of the invention.

The following examples are given to illustrate the invention and are not to be taken as limiting the scope of the invention which is defined by the appended claims.

EXAMPLE I

Figure 2:
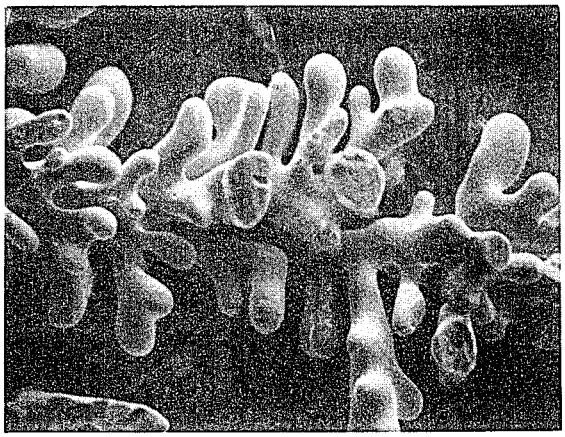
FIG. 2 is a scanning electron micrograph of a 19.5 weight percent tantalum-copper alloy taken at 1900 multiplication.

A copper rod 20" long and 1 3/16" diameter was provided with 6 full length longitudinal slots equally spaced about the periphery. These slots were ½" deep and 1/16" wide. Six tantalum strips 1/16" wide were then forced into the slots and the edges of the slots peened over the strips to hold the tantalum firmly in place. The slotted copper rod weighed 2600 gms while the total weight of the tantalum in the rod was 628 gms forming an electrode weighing 3268 gms, and containing 19.5 weight percent tantalum. The electrode was then hung in a dc consumable arc furnace as the negative electrode. The free end of the electrode extended into a 2½ inch diameter water-cooled copper mold which contained a ¼ inch thick graphite liner. At the bottom of the mold was a small copper striking pad on which was placed about 20 gms of copper turnings to aid in establishing the arc. The furnace was sealed, evacuated and backfilled with about ⅔ atmosphere of argon. The current was set at about 1750 amps dc and the arc was struck. An inch or two of the electrode quickly melted, exposing the tantalum strips. The arc then jumped to the longest exposed tantalum strips melting one strip after the other. The copper melts back from the heat of the tantalum. During the melting, the voltage was maintained at between 28 and 30 volts by carefully adjusting the distance of the tip of the longest tantalum from the melt in the mold. When the electrode was completely melted, the ingot was cooled to room temperature and removed from the mold. The scanning electron micrographs of FIGS. 1 and 2 show the dendrites of tantalum dispersed in the copper matrix.

EXAMPLE II

The periphery of copper rod 37½" long and 1¼" diameter was provided with 6 full-length longitudinal slots 1/16 inch and ⅜" deep. Into the slots was placed 1/16" strips of tantalum 37½" long, the edges of the slots were peened over to completely cover the tantalum strips. Small holes were drilled through the tantalum strips into the copper rod at the mounting end of the electrode and copper pins placed in the holes. This was to prevent any unmelted tantalum from falling into the melt. The weight of the slotted copper was 5673 gms and the total weight of the tantalum was 1283 gms to form a copper alloy containing 18.45 percent tantalum. The electrode was placed in a dc consumable arc furnace and melted as described in Example I. SEM examination of the completed ingot showed the presence of discrete, randomly distributed and oriented dendritic-shaped particles of tantalum.

As can be seen from the preceding examples and discussion, the process of the invention provides a method for the preparation of tantalum copper alloys.

The embodiments of this invention in which an exclusive property or privilege is claimed are defined as follows:

1. A method of making a tantalum-copper alloy comprising:

preparing a consumable electrode consisting of an elongated copper billet containing at least two spaced apart tantalum rods extending longitudinally the length of the billet, the weight percentage of tantalum in the electrode being equal to the weight percentage of tantalum in the alloy;

striking and maintaining a dc arc between one end of the electrode and a container to receive the molten electrode, to initiate melting of the electrode into the container to form the alloy;

controlling the distance between the end of the electrode and the molten alloy in order to melt the tantalum at about the same rate as the copper is melted, so that as the electrode is melted a molten homogeneous mixture of tantalum and copper is formed in the receiver; and, cooling the molten homogeneous mixture of copper and tantalum thereby forming a tantalum-copper alloy.

2. The method of claim 1 wherein the electrode contains at least 4 spaced apart tantalum rods extending longitudinally the length of the billet.

3. The method of claim 2 wherein the electrode contains up to 50 weight percent tantalum.

4. The method of claim 3 wherein cooling of the mixture is retarded slightly in order to ensure homogenity of the alloy.

5. The method of claim 4 wherein the electrode is prepared by providing at least four longitudinal slots, evenly spaced about the periphery, and extending the length of the copper billet, providing each slot with tantalum, the tantalum being about uniform in cross-section and extending the length of the billet, and enclosing the tantalum in the slot with copper to hold the tantalum firmly in place.

6. The method of claim 5 wherein the receiver for the molten alloy is a water-cooled copper mold.

7. The method of claim 6 wherein the copper mold is lined with graphite to retard the rate of cooling.

8. The method of claim 7 wherein the electrode contains 6 evenly spaced longitudinally extending slots containing tantalum.

* * * * *